United States Patent [19]

Ombredane

[11] Patent Number: 4,903,972

[45] Date of Patent: Feb. 27, 1990

[54] DEVICE FOR SEALING AN ENCLOSURE CONTAINING AN EXPANDABLE FLUID, ESPECIALLY WITHIN AN ELECTRICAL CONNECTION ASSEMBLY

[75] Inventor: Etienne Ombredane, Bure sur Yvette, France

[73] Assignee: Thomson-CGR, Paris, France

[21] Appl. No.: 135,231

[22] Filed: Dec. 21, 1987

[30] Foreign Application Priority Data

Dec. 23, 1986 [FR] France ..... 86 18086

[51] Int. Cl.[4] ..... B61D 53/00; B61F 15/22

[52] U.S. Cl. ..... 277/171; 277/174; 277/177; 277/901

[58] Field of Search ..... 277/168–174, 277/177, 72 FM, 22, 15, 16, 901; 285/187, 356, 359

[56] References Cited

U.S. PATENT DOCUMENTS

| | | | |
|---|---|---|---|
| 2,118,613 | 5/1938 | Lamm | 277/171 |
| 2,708,573 | 5/1955 | Rovoldt | 277/173 |
| 3,071,386 | 1/1963 | Scannel | 277/177 |
| 3,698,728 | 10/1972 | Walker | 277/177 X |
| 4,072,154 | 2/1978 | Anderson et al. | 277/177 X |
| 4,203,607 | 5/1980 | Brieger | 277/72 FM |
| 4,577,870 | 3/1986 | Scott et al. | 277/177 X |

FOREIGN PATENT DOCUMENTS 1377420 9/1964 France .

*Primary Examiner*—Harvey C. Hornsby
*Assistant Examiner*—M. Spisich
*Attorney, Agent, or Firm*—Oblon, Spivak, McClelland, Maier & Neustadt

[57] ABSTRACT

A sealing device for an enclosure containing an expandable fluid, particularly for high-voltage connectors, ensures fluid-tightness over a broad temperature range and provides a safety function by accommodating variations in volume of the fluid by the use of an O-ring seal displaceably clamped within an annular recess. A sectional length L1 of the recess in which the seal can take up n positions is constituted by an initial-clamping space and by a clearance space into which the seal can penetrate under the pressure of fluid.

11 Claims, 3 Drawing Sheets

DEVICE FOR SEALING AN ENCLOSURE CONTAINING AN EXPANDABLE FLUID, ESPECIALLY WITHIN AN ELECTRICAL CONNECTION ASSEMBLY

BACKGROUND OF THE INVENTION

1. Field of the Invention

This invention relates to a device for sealing an enclosure which contains an expandable fluid, this device being particularly suitable for sealing within a high-voltage electrical connection assembly which makes use of an electrical insulating fluid.

2. Description of the Prior Art

Electrical connection assemblies are in common use, especially in the field of radiology in which they are used for supplying high voltage to x-ray tubes.

To take as an example the supply of an x-ray tube, at least one of the positive or negative polarities of the high voltage applied to the x-ray tube exhibits a considerable difference in voltage with respect to ground. The x-ray tube is usually contained within a protective housing which is brought to ground potential and in which the x-ray tube is connected to electrical connection means which are rigidly fixed to the housing and terminate outside this latter. These connection means associated with the housing usually constitute receptacles formed by a female component in the bottom of which is placed at least one electric contact element connected to the x-ray tube. The high voltage produced by a high-voltage generator is supplied to the receptacle by means of a high-insulation-resistance cable provided with an end-piece on the cable end to be connected to the receptacle. The end-piece constitutes a male component having a diameter which is smaller than the internal diameter of the receptacle and provided at its extremity with at least a second contact element which is brought to the high-voltage potential. The end-piece is engaged in the receptacle in such a manner as to establish an electric contact between the contact elements.

The male and female components or so-called end-pieces and receptacles, are fabricated from electrically insulating materials and are each endowed with the requisite electrical insulation properties. Along the walls opposite to the end-piece and the receptacle, however, the interface space between these walls is liable to cause breakdown or sparking if this interface space does not have sufficient dielectric rigidity. Consequently, in order to achieve higher electrical insulation, it is a known practice to fill the interface space with an insulating fluid such as oil or grease while taking steps to ensure that no air is incorporated in the fluid. The interface space is closed by a seal which usually has a toric shape so as to be placed around the male component and so as to be clamped between this latter and the female component.

In accordance with a customary practice, the housing which contains the x-ray tube is caused to assume different positions and angles of slope in which the seal prevents the insulating fluid from flowing out to the exterior of the enclosure. It is none the less found that leakages of insulating fluid occur when the x-ray tube has been subjected to intensive operation and when it produces a temperature rise of the housing and consequently a temperature rise of the entire electrical connection assembly.

The inventor has considered that these leakages were due to expansion of the insulating fluid which is not compressible and accordingly exerts on the seal a thrust which is greater as the temperature attained is of higher value, this phenomenon being evidenced by leakages of the insulating fluid which appear only when the x-ray tube is subjected to intensive use and when the entire volume of the enclosure is filled with the expanded fluid. A point worthy of note is that, in the prior art, this phenomenon could eventually produce breakdown of the entire electrical connection assembly in the event that perfect fluidtightness is provided by the seal. Stated in different terms, the seal assumes a safety function by imperfect performance of its sealing function.

SUMMARY OF THE INVENTION

The present invention relates to a sealing device designed in accordance with a novel arrangement which is applicable to all assemblies containing an expandable fluid, especially in an electrical connection assembly for high voltage, which makes it possible to ensure leak-tightness with respect to the expandable fluid over a broad temperature range and which also makes it possible to ensure a safety function as mentioned earlier when the fluid undergoes excessive expansion.

In accordance with the invention, a device for sealing an enclosure fitted with at least one O-ring seal, the enclosure being constituted by the assembly of at least two components between which an internal space contains an expandable fluid, the seal being contained within an annular recess located between the two components about an axis of symmetry, said recess being adapted to communicate with the internal space, said seal being clamped between two opposite walls of the recess, is distinguished by the fact that provision is made along the section of the annular recess for a length in which the seal is capable of moving and of occupying n positions, the length of the annular recess being constituted by an initial clamping space and by a clearance space, the initial clamping space being such as to correspond to an initial position of the seal and the clearance space being located on one side of the seal which is remote from the internal space, with the result that the seal penetrates into the clearance space under the pressure of the expanded fluid.

DETAILED DESCRIPTION OF THE INVENTION

Figure 1:
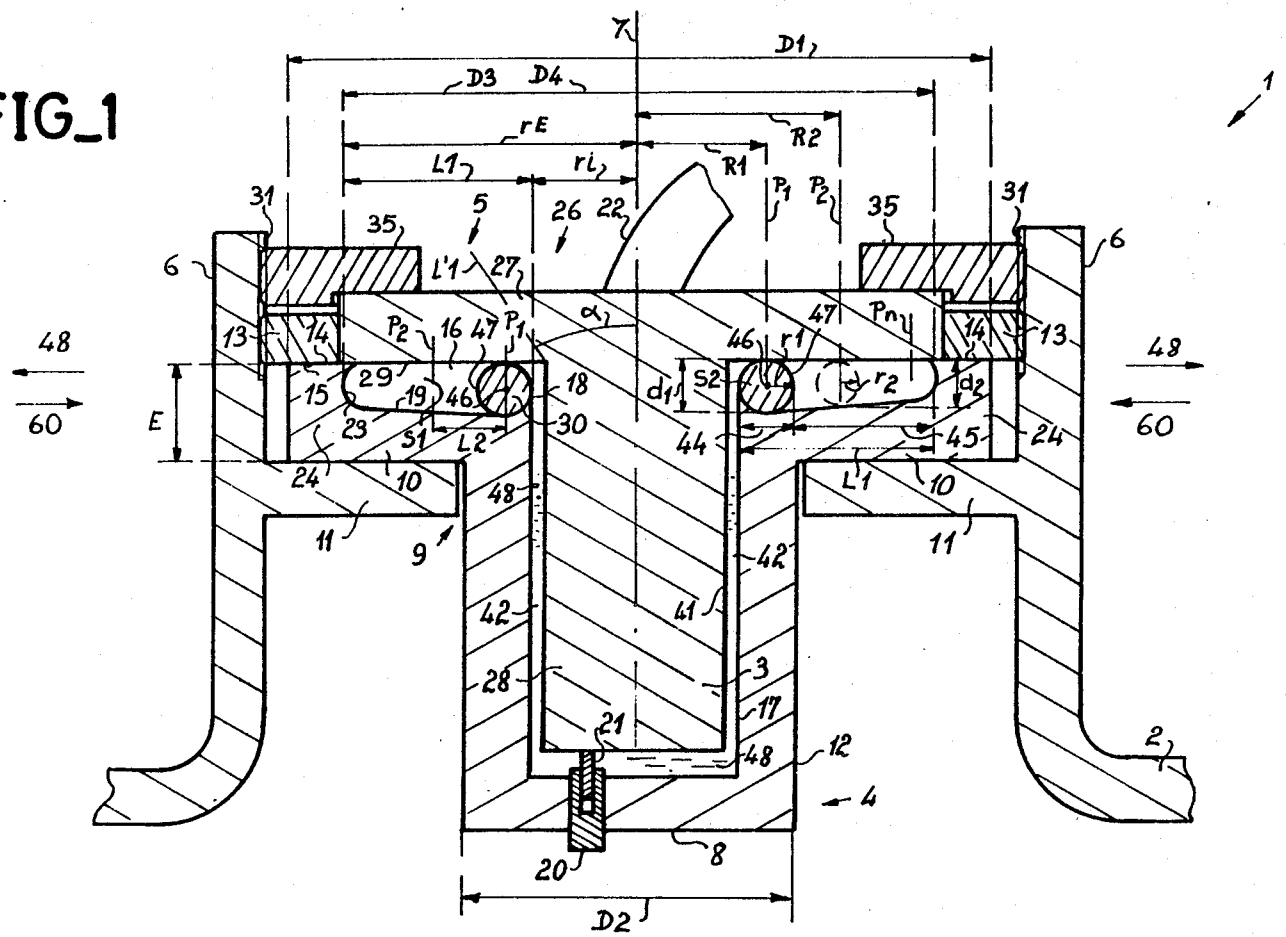
FIG. 1 is a schematic sectional view of an electrical connection assembly, the sealing device according to the invention being employed in this assembly in a preferred embodiment in which a seal is deformed.

FIG. 1 shows by way of non-limitative example a sealing device according to the invention as employed in a high-voltage electrical connection assembly 1 of the type which is intended to be mounted on a housing 2 containing an x-ray tube (not shown in the drawings) in the conventional manner.

The connection assembly 1 includes an end-piece 3 or male component engaged within a receptacle 4 or female component having the general shape of a cylindrical vessel 12. The housing 2 has an orifice 5 of circular cross-section formed by a tube 6 having an axis of symmetry 7. The closed end 8 of the receptacle 4 is engaged within the orifice 5 along the axis of symmetry 7.

The receptacle 4 is provided at its second extremity 9 with an annular attachment flange 10, the external diameter D1 of which is larger than the second external diameter D2 of the cylindrical vessel 12 of the receptacle 4. The receptacle 4 is inserted in the tube 6 so as to ensure that the annular attachment flange 10 is applied against an abutment flange 11 located within the interior of the tube 6. In the non-limitative example described and illustrated in FIG. 1, the annular attachment flange 10 has a top face 14 remote from the abutment flange 11. A hollowed-out portion located above said top face is intended to form an annular recess 16 which is substantially centered about the axis of symmetry 7 and is formed within the thickness E of the annular attachment flange 10. Along the plane of section S1 in which it is represented in the figure, the annular recess 16 has a first extremity 18 in proximity to the interior of the cylindrical vessel 12 and extends over a distance L1 towards a peripheral portion 24 of the annular attachment flange 10 up to the second extremity 23 of the annular recess 16 at which this latter is closed by said peripheral portion 24. The annular recess 16 has a third external diameter D3 which is smaller than the external diameter D1 of the annular attachment flange 10, with the result that the full thickness E of this latter is located in its peripheral portion 24 whereas a reduced thickness (not indicated in the figure) is located in the portion corresponding to the annular recess 16 or in other words between the bottom wall 19 of the recess 16 and the abutment flange 11.

The top face 14 of the annular attachment flange 10 thus constitutes on the peripheral portion 24 a bearing face 15 which is employed for attachment of the receptacle 4.

The receptacle 4 is fixed within the orifice 5 by means of a ring 13 which is screwed into an internally-threaded portion 31 of the tube 6 until it is clamped against the bearing face 15 of the annular attachment flange 10. The receptacle 4 and the end-piece 3 are provided respectively with a first and a second electric contact element 20, 21 which are brought into contact with each other when the end-piece 3 is fully engaged within the receptacle 4. The first contact element 20 is connected in a conventional manner (not shown in the drawings) to the device to be supplied and the second contact element 21 is also connected in a conventional manner by means of an electric cable 22 to a high-voltage generator (not illustrated).

One extremity 26 of the end-piece 3 which is not engaged within the receptacle 4 is provided with a second annular attachment flange 27 having a fourth external diameter D4 which is substantially equal to or greater than the third external diameter D3 of the annular recess 16. The body 28 of the end-piece 3 is engaged within the receptacle 4 so that an underface 29 of the second annular attachment flange 27 is applied above the recess 16 and compresses an O-ring seal 30 within said recess 16. If necessary, the aforesaid underface 29 may also be applied against the bearing face 15.

The end-piece 3 is joined to the receptacle 4 by means of a second ring 35 which is screwed into the internally-threaded portion 31 of the tube 6 in order to clamp the second annular flange 27 against the seal 30 and to compress this latter.

The internal surface 17 of the cylindrical vessel 12 of the receptacle 4 and the external surface 41 of the body 28 of the end-piece 3 are in oppositely-facing relation but are not juxtaposed and these surfaces 17, 41 define between each other an internal space 42 which contains an insulating fluid 48. The internal space 42 communicates with the annular recess 16 which is formed between a first wall constituted by the bottom wall 19 of this latter and a second wall constituted by the underface 29 of the second annular flange 27. The seal 30 is thus clamped between the two opposite walls 19, 29 or in other words between the receptacle 4 and the end-piece 3 so as to ensure leak-tightness of the internal space 42.

The O-ring seal 30 and the annular recess 16 constitute a sealing device in accordance with the invention.

In accordance with a distinctive feature of the invention, the length L1 of the annular recess 16 is formed by an initial space 44 to which is added a clearance space 45. The initial space 44 corresponds to the space occupied by the seal 30 in an initial position P1 of this latter, for example a position in which the seal 30 is clamped between the walls 19, 29 at the moment of fastening of the end-piece 3 to the receptacle 4 and when the fluid 48 is not in the expanded state. This first position P1 is materialized in the figure by a dashed line which passes through the center 46 of the section S2 of the O-ring seal 30. The clearance space 45 constitutes an additional space on one side 47 of the seal 30 remote from the internal space 42 within which the seal 30 can be displaced under the pressure of the fluid 48.

Assuming that, at the outset or in other words in the cold state, the fluid 48 contained in the internal space 42 is flush with the first extremity 18 of the annular recess 16, expansion of the fluid 48 will cause this latter to thrust the seal 30 towards the second extremity 23 of the recess 16 as shown by the arrows 48. The seal 30 being clamped between the walls 19, 29 in the first position P1, for example under a load which is sufficient to prevent leakages of fluid caused by tilting of the connection assembly 1, the seal 30 can occupy n additional positions P2, . . . - Pn with a view to increasing the useful internal space 42 as a function of the expansion of the fluid 48.

The advantage of this configuration lies in the fact that the internal space 42 can be defined by the position P1, P2, . . . - Pn of the seal 30 at the precise value which is necessary in order to compensate for variations in volume of the fluid 48.

In the non-limitative example herein described, the seal 30 has a toric shape in accordance with a conventional design and a circular cross-sectional shape as shown in the figure. It must nevertheless be understood that there would be no departure from the spirit of the invention if the section S2 of the seal 30 were given a different shape. Said seal 30 is placed within the annular recess 16 around the body 28 of the end-piece 3 in a plane substantially normal to the axis of symmetry 7 which also constitutes an axis of symmetry of the seal 30.

The seal 30 being in the first position P1, the O-ring formed by said seal has a first mean radius R1 and the section of said seal 30 has a first radius r1 designated in the remainder of this specification as the short radius r1 in order to differentiate this latter more effectively from the mean radius R1 of the O-ring. Moreover, the annular recess 16 itself constitutes an annulus having the same axis of symmetry 7 as the O-ring formed by the seal 30. The difference between an internal radius ri and an external radius rE of the annulus formed by the recess 16 constitutes the length L1 of this latter in which the seal 30 is displaceable. In consequence, by moving over the distance L1 of the recess 16 from the first position P1 to the second position P2, for example, the seal 30 undergoes a deformation and changes from the first mean radius R1 to a second mean radius R2, this second mean radius R2 being of greater length than the first. Consequently, when the O-ring formed by the seal 30 changes from the first mean radius R1 to the second mean radius R2 of greater length, the section S2 of the seal 30 (represented in dashed lines in the second position P2) changes from the first short radius r1 to a second short radius r2 which is smaller than the first. In order to take into account the reduction in cross-section of the seal 30 with a view to ensuring that clamping of this latter remains substantially constant irrespective of the position P1, P2, . . . - Pn which it occupies within the annular recess 16, the distance d1, d2 between the walls 19, 29 is made progressively variable along the length L1 so that a first distance d1 between the walls 19, 29 near the first extremity 18 of the annular recess 16, that is to say in the first position P1, is greater than a second distance d2 between the walls 19, 29 in the second position P2.

The seal 30 is of flexible elastic material such as, for example, rubber of the acrylonitrile-butadiene type. The O-ring formed by this seal therefore retains a substantially constant volume V when it changes from the first initial mean radius R1 to a second mean radius R2 of greater length and conversely. This conservation of volume of the O-ring formed by the seal 30 can be employed for defining the slope P along which the distance d1, d2 between the two walls 19, 29 must vary. Since the slope P is the ratio of variation in distance $\Delta d = d1 - d2$ to a second length L2 which separates the positions P1, P2 and which has produced this variation in distance $\Delta d$, the slope P is equal to:

$$P = \frac{2(r1 - r2)}{L2} \quad (1)$$

In the non-limitative example described, the length L1 of the annular recess 16 in which the O-ring seal 30 is capable of displacement is substantially perpendicular to the axis of symmetry 7 and the difference between the second and the first mean radius, that is to say R1−R2, directly corresponds to the second length L2 which constitutes the length of displacement of the seal 30 within the recess 16 between the positions P1, P2. However, the section S1 of the annulus formed by the recess 16 can have the same shape while being disposed in a different manner, for example with a view to giving the annular recess 16 a length L'1 (represented by a dashed line in FIG. 1) such as to make with the axis of symmetry 7 an angle $\alpha$ having a value different from 90°, in which case the second length or length of displacement L2 is equal to:

$$L2 = \frac{R2 - R1}{\sin \alpha} \quad (2)$$

The first mean radius R1 as well as the first short radius r1 are known at the outset since the seal 30 is not deformed in the first position P1 and the volume V of the seal 30 is known and corresponds to:

$$V = 2\pi^2 \cdot R1 \cdot r1^2 \quad (3)$$

Since the volume V is constant in the deformations of the seal 30, the second short radius r2 exhibited by the section of the seal 30 in the second position P2 is given by the following relation:

$$r2 = \sqrt{\frac{V}{2\pi^2 \cdot R2}} \quad (4)$$

where R2 is the second mean radius exhibited by the annulus formed by the seal 30 in the second position P2. In consequence, the mean angle of slope P at which the distance d1, d2 between the walls 19, 29 varies is given by the following relation:

$$P = \frac{2}{L2}\left(r1 - \sqrt{\frac{V}{2\pi^2 (L2 \sin \alpha + R1}}\right)$$

In this first embodiment of the invention in which the O-ring seal 30 is displaced within the annular recess 16 under the pressure of the expanded fluid 48 along a length L1 which is not parallel to the axis of symmetry 7, the seal 30 is deformed during these displacements, for example when it moves from the first initial position P1 to the second position P2. Deformation of the O-ring seal constitutes an advantage which assists this latter in returning to the initial first position P1 when the fluid 48 has been restored to its initial volume. In fact, when the fluid undergoes expansion, the seal 30 is thrust back within the recess 16 with a force of greater magnitude than the force exerted within said recess on the first side of the seal 30 which is remote from the internal space 42 by the air which may or may not be trapped within said recess 16. When no provision is made for special sealing means, the pressure which prevails within the recess 16 is that of the external pressure or in other words atmospheric pressure which tends to act in opposition to a movement of penetration of the seal 30 into the recess 16. For example, when the seal 30 has been moved to the second position P2 under the pressure of the expanded fluid 48, said seal remains in this position as long as the volume of expansion of the fluid is maintained. When the fluid 48 subsequently decreases in volume and no longer exerts a thrust on the seal 30, this latter is returned under the action of atmospheric pressure towards the enclosure 42 in the directions shown by the second arrows 60.

To this action of air or atmospheric pressure which tends to thrust the seal 30 towards the initial first position P1 is added the effect produced by elasticity of the seal 30 which has been deformed so as to take up the second position P2 and tends under the action of its own elasticity to be restored to its first mean radius R1 which corresponds to the first position P1 or initial position of the seal 30.

This first embodiment of the invention is particularly advantageous by virtue of the fact that, as a result of a small increase in the mean radius R1 of the O-ring which forms the seal 30, it is possible to obtain an increase in the internal space 42 which is considerably greater than the increase in volume which the fluid 48 is capable of acquiring by expansion. In fact, assuming that the electrical connection assembly 1 is of a conventional type and that the diameter (not shown) of the body 28 of the end-piece 3 is of the order of 20 mm:

the insulating fluid 48 contained within the internal space 42 in the cold state or in other words at room temperature has a volume of substantially 5 $cm^3$; with a conventional insulating fluid such as oil or grease, this volume increases by approximately 0.5 $cm^3$ in respect of an increase in temperature of the order of 100° C.;

and assuming that, in the first position P1, the first distance d1 between the walls 19, 29 is of the order of 5 mm or slightly less than the section of the seal 30 and that the first mean radius R1 is of the order of 22 mm, a displacement of the seal 30 over a second length L2 of the order of 2.5 mm frees a space having a volume greater than 2.5 $cm^3$ or in other words several times greater than the increase in volume of the insulating fluid 48 over a temperature range of 100° C.

In the non-limitative example herein described, the annular recess 16 is formed between the wall 29 or underface of the end-piece 3 and the wall 19 of the receptacle 4. More specifically, the annular recess 16 is formed by a channel formed in the top face 14 of the first annular flange 10 which forms part of the receptacle 4. However, it must be understood that, in the -spirit of the invention, the recess 16 can be formed differently, for example by hollowing-out the underface 29 of the second annular flange 27. It is also possible to form the recess 16 in an intermediate member (not shown in FIG. 1) so as to avoid any need for complementary machining of the receptacle 4 and the end-piece 3 which, in the case of standardized electrical connection assemblies 1, constitute standard elements having fixed and standardized dimensions.

Figure 2:
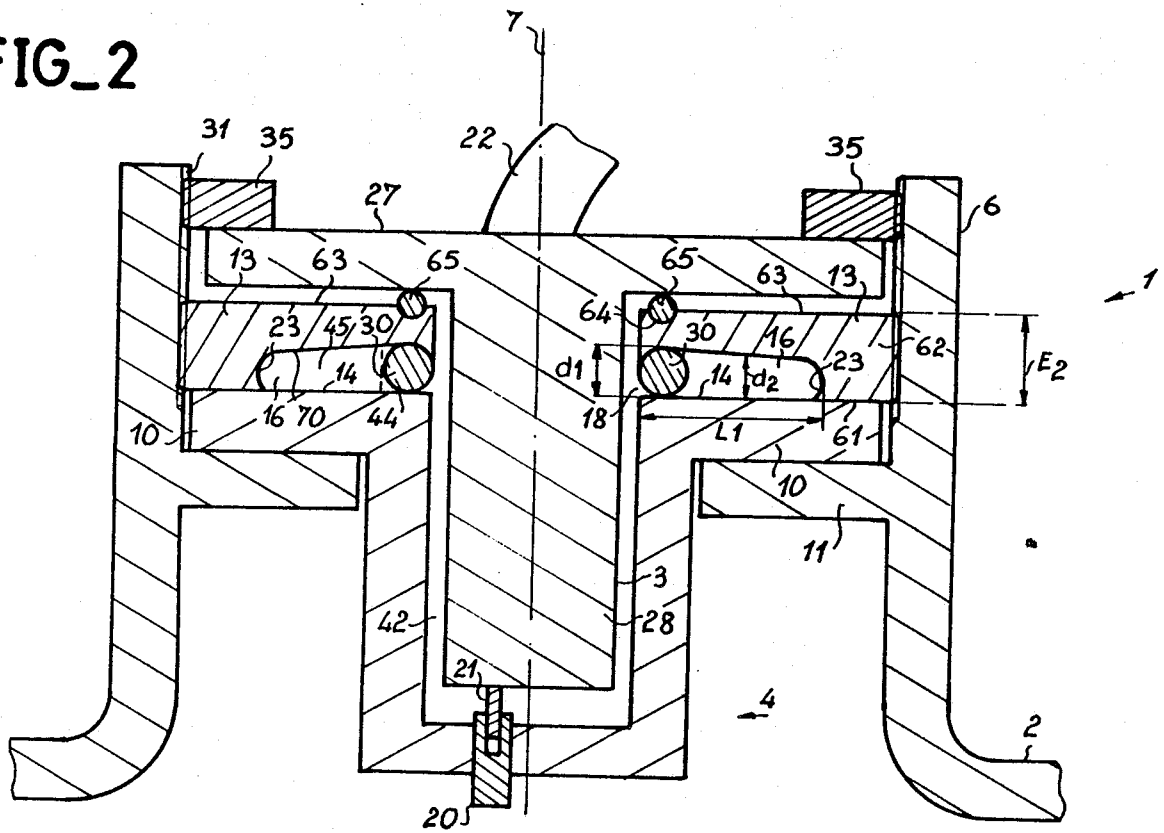
FIG. 2 is a schematic sectional view of the electrical connection assembly, showing an alternative form of construction of the first embodiment of the sealing device according to the invention with a deformed seal.

FIG. 2 shows the electrical connection device 1 in which the sealing device in accordance with the invention includes an intermediate member for the purpose of forming the annular recess 16, the seal 30 being deformed in the same manner as in the preceding example when displaced within said recess 16.

The receptacle 4 is applied against the abutment flange 11 of the tube 6 by means of the first annular attachment flange 10 and is clamped in position by means of the first ring 13. In the non-limitative example herein described, a clamping face 61 of the first ring 13 which is oriented towards the top face 14 of the first annular flange 10 has been cut in a second thickness E2 of the ring 13 so as to constitute the annular recess 16. In this embodiment, the first ring 13 constitutes the aforementioned intermediate member. The recess 16 thus extends along its length L1 from the internal space 42 to a second peripheral portion 62 of the ring 13 which closes the second end 23 of the recess 16. In this peripheral portion 62, the ring 13 has its full thickness E2. The second face 63 of the ring 13 which is oriented towards the second annular flange 27 of the end-piece 3 has a groove 64 in which is fitted a second seal 65 or so-called static seal. The end-piece 3 is engaged within the receptacle 4 in the same manner as in the previous example and is clamped in position by the second clamping ring 35 so as to compress the static seal 65.

Under these conditions, leak-tightness of the internal space 42 is achieved in the first place by the static seal 65 which retains a fixed position in the conventional manner. In the second place, leak-tightness of the enclosure 42 is achieved by means of the movable seal 30 which, as in the previous example, is capable of displacement in a movement of penetration into the annular recess 16 as a function of the expansion of the insulating fluid 48. In this embodiment of the invention, the walls of the annular recess 16 are formed in the case of the first wall by the top face 14 of the annular flange 10 and in the case of the second wall by the surface 70 which is cut in the first clamping ring 13. These two walls 14, 70 are relatively spaced at a distance d1, d2 which progressively decreases along the length L1 as considered in a direction of motion away from the internal space 42, and as in the previous example. The advantage of this embodiment of the invention lies in the fact that it permits the formation of a recess 16 having the same properties as in the previous example but without modifying either the receptacle 4 or the end-piece 3, this result being achieved by simple machining of the first clamping ring 13.

Figure 3:
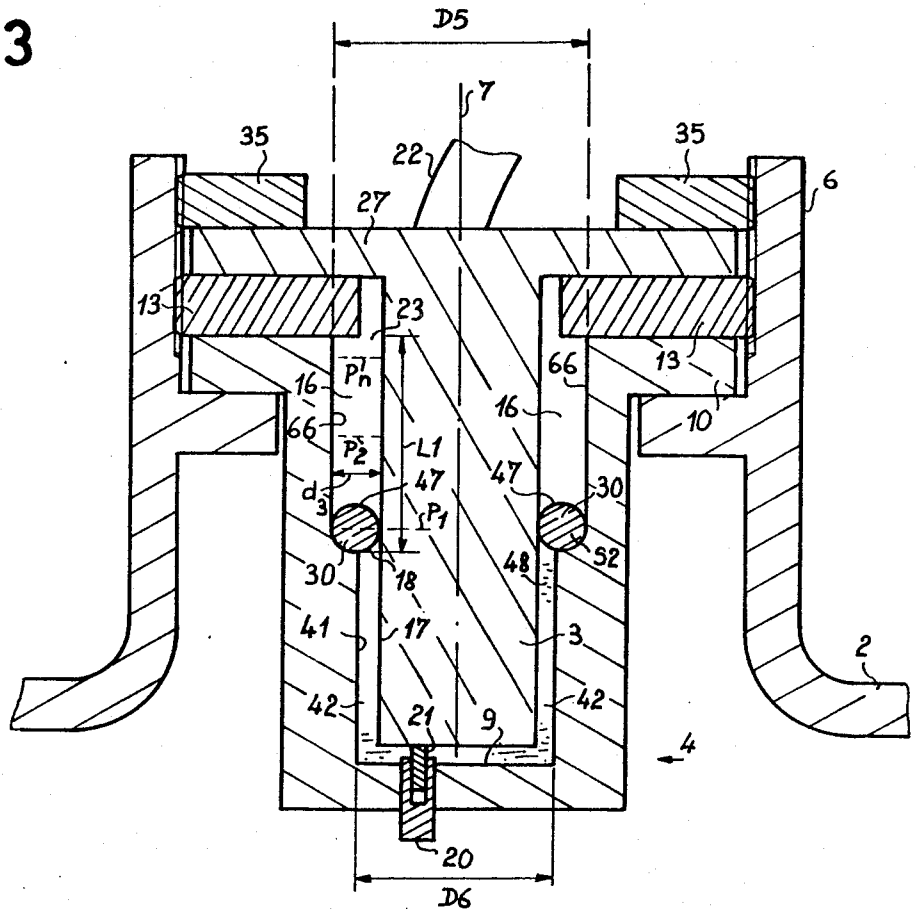
FIG. 3 is a schematic sectional view of the electrical connection assembly and illustrates a second embodiment of the sealing device according to the invention.

FIG. 3 shows the electrical connection assembly 1 and illustrates an embodiment of the sealing device according to the invention in which the length L1 of the annular recess 16 is substantially parallel to the plane of symmetry 7.

The receptacle 4 is fixed within the tube 6 by means of the first clamping ring 13 which is brought into a position in which it is applied against the first annular flange 10. The end-piece 3 is engaged within the receptacle 4, with the result that its second annular flange 27 is applied against the first clamping ring 13 by means of the second clamping ring 35. The internal space 42 is defined as in the previous examples between the internal and external surfaces 41, 17 of the receptacle 4 and of the end-piece 3 from the bottom endwall 9 of the receptacle 4 up to the first extremity 18 of the annular recess 16. The recess 16 is located in the line of extension of the internal space 42 and its length L1 is disposed in a direction parallel to the axis of symmetry 7. The recess 16 is formed between the external surface 17 of the body 28 of the end-piece 3 and an internal wall 66 of the receptacle 4 at which said receptacle has a fifth internal diameter D5 of greater length than a sixth diameter D6 measured across the internal space 42 of said receptacle. In consequence, the first extremity 18 of the annular recess 16 has the shape and function of an abutment shoulder against which the seal 30 can be applied in the first position P1. The seal 30 is placed within the recess 16 and constitutes a ring around the body 28 of the end-piece 3, the plane of said ring being normal to the axis of symmetry 7. In the non-compressed state (not shown), the seal 30 has a diameter which is slightly longer than the third distance d3 between the walls 66, 17 of the recess 16. In the nonlimitative example herein described, the first ring 13 has the same internal diameter (not shown) as the sixth diameter D6 in order to close the recess 16 to a partial extent at its second extremity 23.

The enclosure 42 is filled with insulating fluid. When the insulating fluid 48 expands, it thrusts the seal 30 into the recess 16 towards the second extremity 23 of this latter, with the result that the seal 30 occupies another position P2, Pn located nearer to the second extremity 23 of the recess 16 as the insulating fluid has expanded to a greater extent. Since the first side 47 of the seal 30 is in free air or at atmospheric pressure, the seal 30 is thrust back to the first position P1 when the fluid 48 decreases in volume. In this embodiment of the invention in which the length L1 of the recess 16 is substantially parallel to the axis of symmetry 7 along which the seal 13 also moves, the seal 30 does not undergo any deformation which would result in modification of the radius of its section S2. In consequence, the walls 66, 17 of the recess 16 can be parallel or in other words at a constant distance d3 from each other. In order to assist the return of the seal 30 to the first position P1, it is nevertheless possible to provide the annular recess 16 with walls 66, 17 which are not parallel to each other in order to ensure that the distance from one wall to the other decreases progressively towards the second extremity 23 of the recess 16 with a fairly low angle of slope.

In this configuration as in the preceding configurations, the seal 30 does not need to be powerfully clamped within the recess 16 since it is not required to afford resistance to very high pressures of the expanded fluid by reason of the fact that it is displaced and increases the useful volume of the enclosure 42 as a function of the expansion of fluid. In consequence, assuming that the reserve volume constituted by the recess 16 is insufficient to compensate for expansion of the fluid, the seal 30 sets up only a relatively low resistance to the fluid which is permitted to pass out of the electrical connection assembly 1, thus preventing breakdown of this latter.

The invention is applicable to enclosures containing an expandable fluid and is particularly wellsuited to high-voltage electrical connection assemblies for ensuring leak-tightness with respect to the fluid which serves to provide enhanced electrical insulation.

What is claimed is:

1. A device for sealing an enclosure containing an expandable fluid, including at least one O-ring seal, the enclosure being constituted by the assembly of at least two components between which an internal space contains the expandable fluid, the seal being contained within an annular recess located between the two components about an axis of symmetry, said recess being adapted to communicate with the internal space, said seal being clamped between two opposite walls of said recess, wherein provision is made along the section of the annular recess for a length L1 in which the seal is capable of moving and of occupying n positions, the length L1 of the annular recess being constituted by an initial clamping space and by a clearance space, the initial clamping space being such as to correspond to an initial first position P1 of the seal and the clearance space being located on one side of the seal which is remote from the internal space so that the seal penetrates into said clearance space under the pressure of the expanded fluid, the two components between which the annular recess is formed being constituted by a female component and a male component of which the body is engaged in said female component, the male and female components being such as to form a high-voltage electrical connection assembly, the internal space being defined between the body of the male component and the internal surface of the female component, the male and female components being provided respectively with a first and a second annular attachment flange between which is disposed the annular recess containing the seal.

2. A sealing device according to claim 1, wherein the walls of the annular recess are located at a distance from each other which decreases in a substantially progressive manner along the length L1 of the recess from the internal space to one extremity of said recess which is remote from the internal space.

3. A sealing device according to claim 2 in which the seal forms around the axis of symmetry an O-ring having a constant volume, wherein a mean slope P along which the distance between the walls of the annular recess varies is related to a modification of the radius r1, r2 of the section of the seal and to a modification of the mean radius R1, R2 of the O-ring formed by the seal when said seal moves from a first position P1 to a second position P2 within said recess.

4. A sealing device according to claim 3, wherein the slope P along which the distance between the walls varies is given by the following relation:

$$P = \frac{2}{L2}\left(r1 - \sqrt{\frac{V}{2\pi^2\,(L2 \sin \alpha + R1}}\right)$$

where r1 is a first radius of the section of the seal in the first position P1;

R1 is a first mean radius of the O-ring formed by the seal in the first position P1;

L2 is a second length between the first and the second position P1, P2 ;

$\alpha$ is the angle formed between the length L1 of the recess and the axis of symmetry;

V is the volume of the seal.

5. A sealing device according to claim 1, wherein the seal and the length L1 of the annular recess are substantially contained in the same plane.

6. A sealing device according to claim 5, wherein the plane of the seal is substantially normal to the axis of symmetry.

7. A sealing device according to claim 1, wherein the length L1 of the annular recess is substantially parallel to the axis of symmetry.

8. A sealing device according to claim 7, wherein the walls forming the annular recess are substantially parallel.

9. A sealing device according to claim 1, wherein at least one intermediate member is placed between the two annular attachment flanges and wherein said annular recess is formed between said intermediate member and at least one of said two annular flanges.

10. A sealing device according to claim 9, wherein a second static seal is placed between the intermediate member and the annular flange which is remote from the annular recess.

11. A sealing device according to claim 1, wherein the annular recess is formed between the body of the male component and an internal wall of the female component, the length L1 of the annular recess being in the line of extension of the internal space and parallel to the axis of symmetry.

* * * * *